US005993620A

United States Patent [19]

Meneghini et al.

[11] Patent Number: 5,993,620

[45] Date of Patent: Nov. 30, 1999

[54] ANODE FOR DIAPHRAGM ELECTROCHEMICAL CELL

[75] Inventors: Giovanni Meneghini, Milan, Italy; Takashi Oishi, Sao Paulo, Brazil

[73] Assignee: De Nora S.p.A., Italy

[21] Appl. No.: 09/052,727

[22] Filed: Mar. 31, 1998

[30] Foreign Application Priority Data

Apr. 10, 1997 [IT] Italy ..... MI97A0816

[51] Int. Cl.[6] ..... C25B 11/00

[52] U.S. Cl. ..... 204/286; 204/284; 204/288; 204/252; 204/253; 205/505; 205/517; 205/521; 205/526; 205/531; 205/532; 205/535

[58] Field of Search ..... 204/284, 286, 204/288, 283, 252, 253, 289; 205/505, 517, 521, 526, 531, 532, 535

[56] References Cited

U.S. PATENT DOCUMENTS

| | | | |
|---|---|---|---|
| 3,674,676 | 7/1972 | Fogelman | 204/288 |
| 3,981,790 | 9/1976 | Olson et al. | 204/284 |
| 4,033,849 | 7/1977 | Pohto et al. | 204/288 |
| 4,154,667 | 5/1979 | Pohto et al. | 204/288 |
| 4,283,265 | 8/1981 | Byrd | 204/286 |
| 4,338,179 | 7/1982 | Dickson et al. | 204/284 |
| 4,448,664 | 5/1984 | Ikegami et al. | 204/288 |
| 5,100,525 | 3/1992 | Pohto et al. | 204/286 |
| 5,593,555 | 1/1997 | Klatt et al. | 204/286 |

*Primary Examiner*—Bruce F. Bell
*Attorney, Agent, or Firm*—Bierman, Muserlian and Lucas

[57] ABSTRACT

The invention discloses a novel structure for an expandable anode to be used in diaphragm cells. This new structure comprises a conductor bar in the form of a copper core provided with a titanium layer having a first and a second pair of flexible expanders fixed thereto. The welding points of the second pair of expanders are positioned orthogonally with respect to the welding points of the first pair of expanders along the circumference of the conductor bar. Also the anode surfaces are connected by welding points to the pairs of expanders. The anode of the invention may be both a new anode and a conventional existing anode having only a first pair of expanders whereto the second pair of expanders is attached. With the device of the present invention the ohmic drop between the conductor bar and the anode surface is substantially decreased and further there is no risk of damaging the interface between the copper core and the titanium coating by an excessive thermal stress, due to the welding procedures.

6 Claims, 4 Drawing Sheets

ANODE FOR DIAPHRAGM ELECTROCHEMICAL CELL

BACKGROUND OF THE INVENTION

The worldwide production of chlorine is about 45 millions of tons per year, about 20 of which are produced by electrolysis of a sodium chloride solution by the diaphragm electrolysis process.

FIG. 1 schematizes a modern diaphragm cell comprising an anode base (A) having the anodes (B) fixed thereto by means of a copper conductor bar (D) protected by a titanium layer. The cathode (C) is made of perforated plates or iron meshes on which a diaphragm is deposited from the anode side. The cover (G), made of a plastic material resistant to chlorine, is provided with an outlet (H) for the chlorine gas and an inlet for the feed brine (not shown in the figure).

Hydrogen and caustic soda are withdrawn from the cathode compartment through outlets (I) and (L) respectively. The diaphragm, substantially made of asbestos fibers and a plastic binder, separates the anode compartment from the cathode compartment avoiding mixing of the two gases and of the solutions (catholyte and anolyte)

In view of its technical-commercial importance, the diaphragm process technology has been recently improved to reduce the energy consumption and to avoid the use of asbestos which is considered a dangerous agent for the human health, by resorting to diaphragms made of zirconium oxide fibers and plastic materials, such as polytetrafluoroethylene.

Among the various other developments introduced in the diaphragm process, particularly important under an industrial point of view are:

1. replacement of graphite anodes with DSA® anodes of the box type;
2. replacement of box-type anodes with expandable anodes (U.S. Pat. No. 3,674,676);
3. anode in contact with the diaphragm in the so-called "zero gap" configuration (U.S. Pat. No. 5,534,122). This result is obtained introducing inside the expandable anode suitable devices capable of applying pressure against the anode surfaces.

FIG. 2 shows a typical expandable anode comprising two anodic surfaces (E), connected to the conductor bars (D) by means of flexible sheets called expanders (F), which, during assembling, are kept in the contracted position by the so-called retainers (N). The retainers are removed after assembly to let the anodic surfaces (E) expand. It is clear that the expanders have not only the function to make the two anodic surfaces (E) mobile but also to make electric current flow from the vertical conductor bar (D) to the anodic surfaces (E). In order to ensure a sufficient elasticity the expanders are made of a thin titanium sheet, for example 0.5 mm thick. As a consequence, a remarkable voltage drop localized in the expanders is experienced, about 1–2 times higher than that typical of the box anode. For example, a conventional box anode of the MDC 55-type cell, operating at 2.5 kA/m$^2$, 95° C., has a voltage drop of 40–50 mV vs. 100–120 mV of a similar expandable anode. Likewise, a conventional box anode of the MDC 29-type cell, operating at 2.5 kA/m$^2$, 95° C., has a voltage drop of 50–60 mV vs. 110–130 mV of a similar expandable anode.

The invention described in Brazilian Patent Application No. Pl9301694 suggests a solution to reduce the ohmic drop in the expander. The invention consists in welding two or more superimposed expanders having the same thickness (0.5 mm) in order to increase the cross section for the electric current flow and avoid a reduction of elasticity. In practical applications this solution proved to be far from optimum and did not find any industrial applications up to now, due to the following reasons:

- it is extremely difficult inserting and welding two superimposed expanders and even more a new expander onto an existing one, which is usually deformed after prolonged use. As a consequence the two expanders do not match and in the contracted position there is a "surplus of material" which deformates the expander.
- Deformation of the expanders in the contracted position poses problems for both the insertion of the retainers and for positioning the anodes onto the anode base to obtain a good planarity The problems affecting the expanders in the contracted position seriously influence the expansion action when the retainers are removed. Consequently the pressure on the diaphragm is not uniform, the two active surface are not sufficiently parallel and the distance of the same from the diaphragm is not constant. The operation of the anode and of the diaphragm is therefore badly affected.

It must be noted that welding of one or more superimposed expanders causes a remarkable voltage drop at the interface between the copper core of the conductor bar and the titanium layer. Discontinuities are created at this interface as a consequence of the increased thermal stress during the welding procedure (higher temperature for a longer time). These effects are decidedly negative when welding of the second expander is made on existing conductors already deteriorated after years of operation. The voltage saving is even completely nullified when three superimposed expanders are welded.

SUMMARY OF THE INVENTION

It is an object of the present invention to provide a new anode suitable for diaphragm cells and capable of substantially overcoming the inconvenience of the prior art and characterized by

- lower voltage drop in the expander without negatively affecting its flexibility
- parallel expansion of the anode surfaces
- uniform pressure onto the diaphragm, remaining constant with time
- lower voltage drop at the welding points between the conductor bar and the expander.

This anode is particularly useful for diaphragm chlor-alkali electrolysis. It is a further object of the present invention to provide for an efficient and proper method of reducing the voltage drop inside an existing anode structure already provided with conventional expander by inserting additional conventional expanders without increasing the voltage drop between the contact point and the conductor bar (copper core and titanium layer).

The decrease in the voltage drop has been substantially obtained by adding a second pair of expanders to the first pair of expanders conventionally used. These new expanders are connected by means of welding spots which are positioned orthogonally with respect to the welding spots of the first pair: the spaced-apart location of the welding spots allows a certain optimum and uniform elasticity both in the expanded and in the contracted positions to be easily maintained without negatively affecting the effectiveness of the electric contact at the interface between the copper core and the titanium layer of the conductor bar. The addition of the second pair of expanders according to this invention is particularly suitable for reducing the voltage drop or increasing the pressure exerted by the first pair of expanders yielded by the long term operation.

DETAILED DESCRIPTION OF THE INVENTION

The invention will be now described making reference to the figures, wherein:

FIG. 3 represents a front view, 3A, and a top view, 3B, section of an expandable anode of the present invention.

Figure 4A:
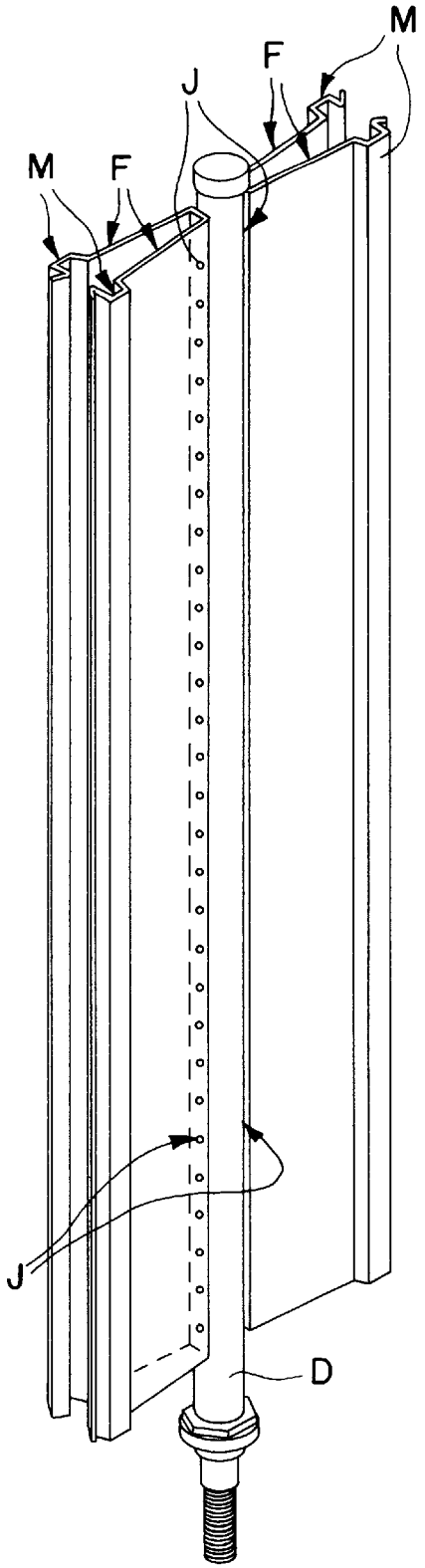
FIG.4A PRIOR ART
FIG. 4 shows a front view 4A and a top view 4B of a conventional expandable anode.
Figure 4B:
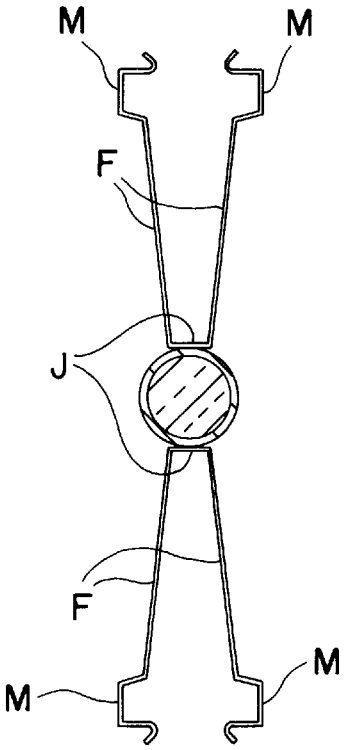
FIG.4B PRIOR ART

FIG. 4 is a front view, 4A, and a top view, 4B, section of a conventional expandable anode.

For simplicity sake, in the four sketches the anodic surfaces (E) have been omitted.

Figure 1:
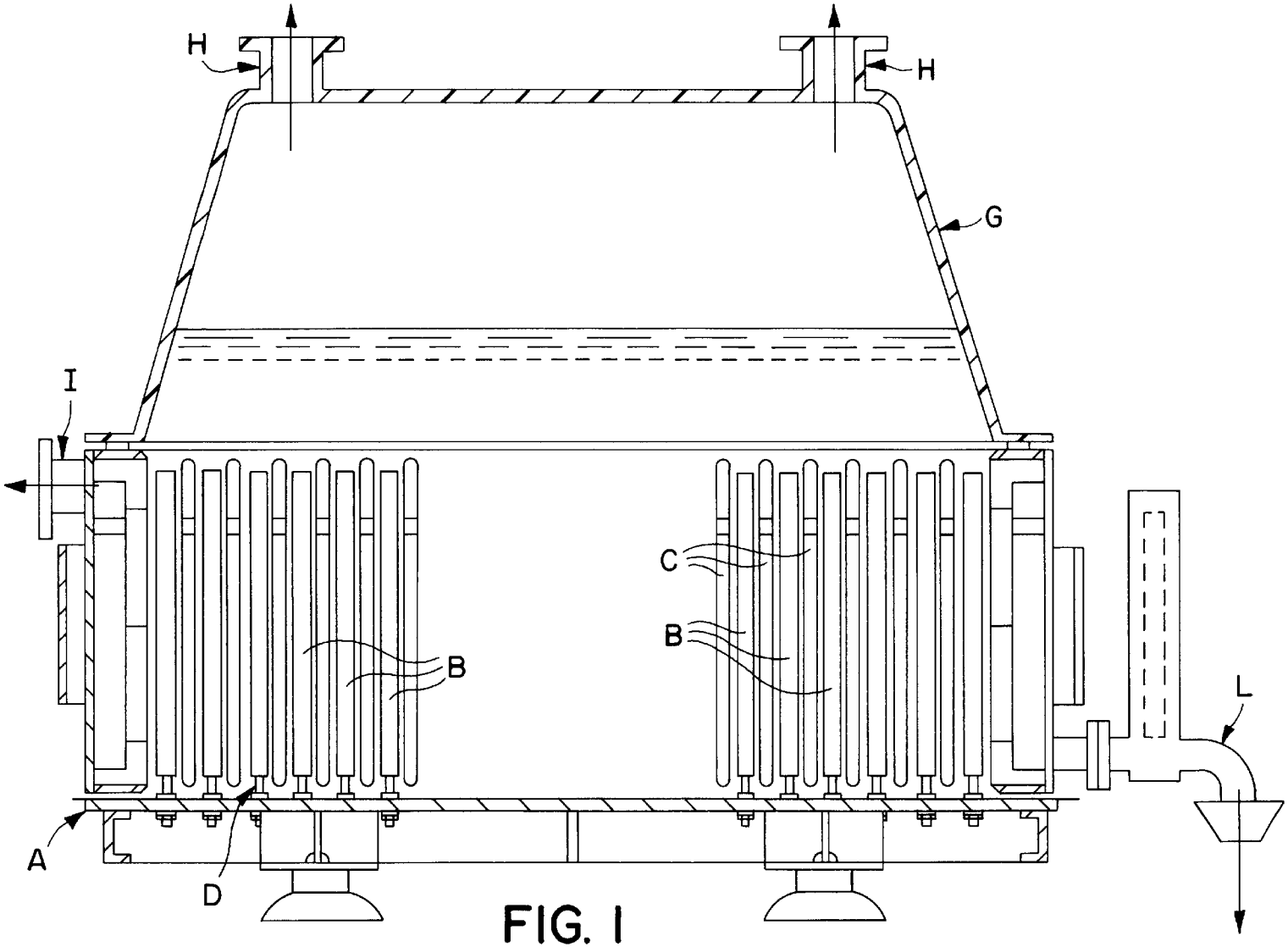
FIG. 1 PRIOR ART
FIG. 1 shows a modern diaphragm cell.
Figure 2:
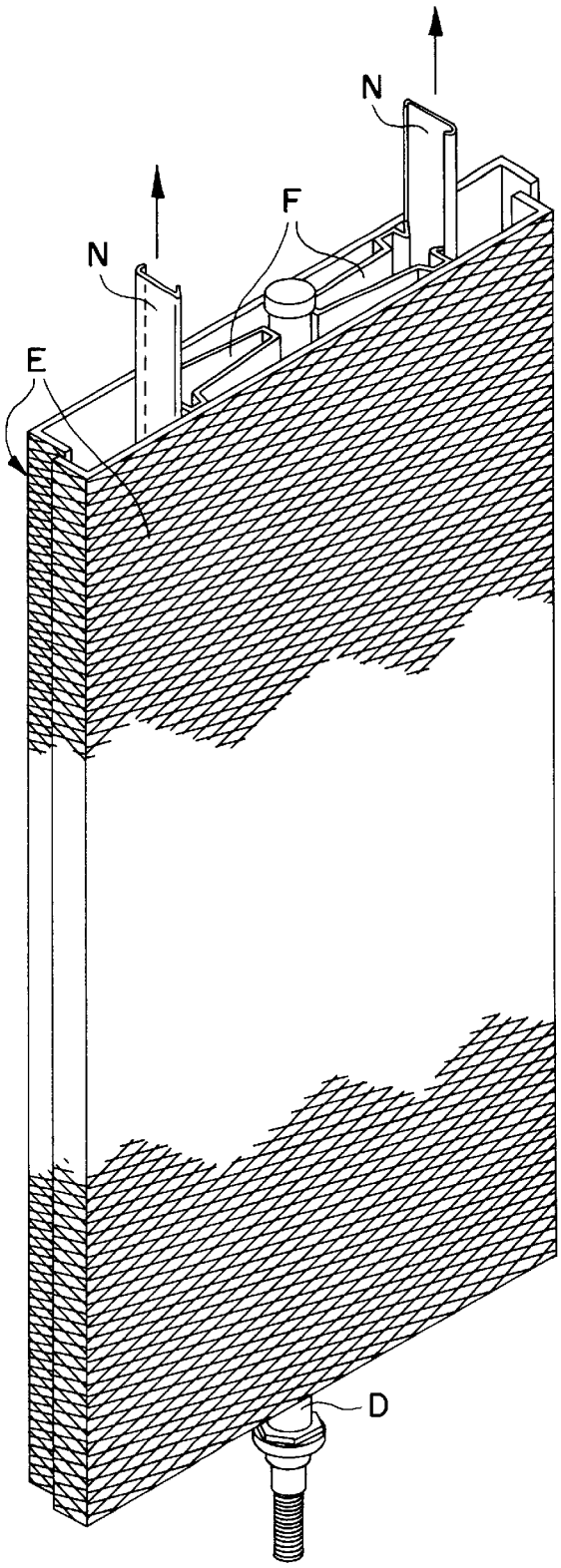
FIG.2 PRIOR ART
FIG. 2 shows a typical expandable anode.
Figure 3A:
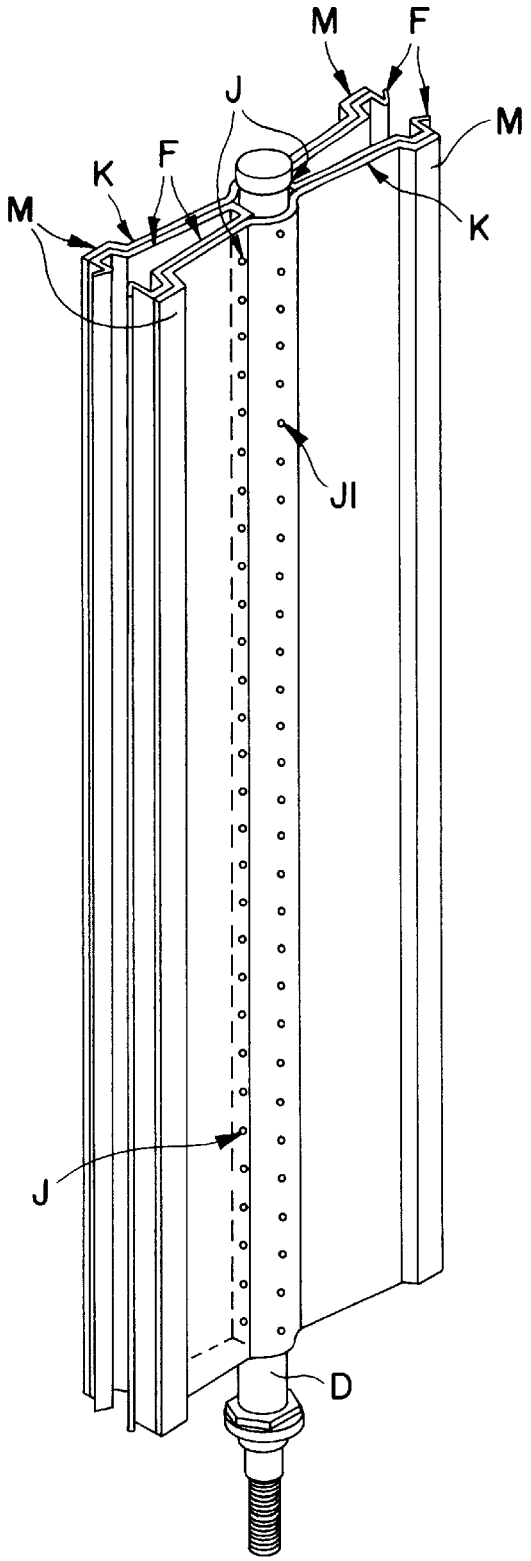
FIG. 3 shows a front view 3A and a top view 3B of an expandable anode of the present invention.
Figure 3B:
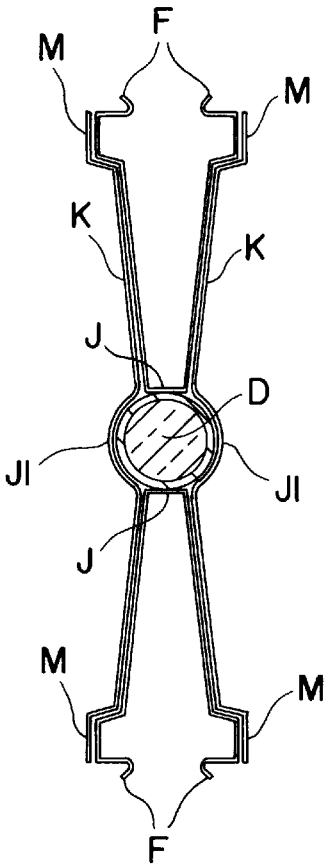

The anode of the invention, either new or after modification of an existing anode, is illustrated in FIGS. 3A and 3B. The anode comprises a current conductor bar (D) (copper core provided with a titanium layer), a pair of expanders (F) welded to the current conductor bar (D) (same as in the prior art), at connection points (J) and a second pair of expanders (K) welded to the current conductor bar (D) at connection points ($J_1$) positioned at 90° (orthogonal) with respect to points J along the circumference of the current conductor bar (D). The anodic surfaces (E in FIG. 2, not shown in FIGS. 3A and B), are fixed, for example by electric arc welding or resistance spot welding, in (M), with welding points which also connect (F) to (K). For a better understanding, FIG. 4 schematizes likewise a conventional anode where the current conductor bar (D) is provided with only one pair of expanders (F), to the ends (M) of which the anode surfaces are welded. It is clear from a comparison of the figures that the electric current is transmitted from the conductor bar to the anode surface with a doubled cross-section in the anode of the invention. The two pairs of expanders of the invention, independently fixed to the conductor bar and only subsequently fixed in a single welding pass to each other and to the anodic surfaces do not cause any deformation or hindrance, neither to the contraction nor to the expansion. Further, the connection points (J) and ($J_1$), orthogonally arranged along the periphery of the conductor bar (D), minimize the welding thermal stress at the interface between the copper core and the titanium layer. Hence, the formation of discontinuities at this interface is easily prevented and the increase in the voltage drop typical of the prior art (Brazilian Patent Application No. Pl9301694) is avoided.

EXAMPLE

The Table reports the voltage drop of conventional anodes compared to the anodes of the invention.

| Type of cell | Anode surface $m^2$ | Current density $kA/m^2$ | Voltage drop at 100° C. with conventional expanders | Voltage drop at 100° C. with the expanders of the invention | Δ mV |
|---|---|---|---|---|---|
| MDC 55 | 0.616 | 2.7 | 83* | 34* | 49 |
| MDC 29 | 0.607 | 2.7 | 86 | 35 | 51 |
| H2A | 0.852 | 2.7 | 133 | 54 | 89 |
| 83B | 0.299 | 2.7 | 77 | 31 | 43 |

*The voltage drop is measured between the copper core of the conductor bar and the anodic surfaces in the welding points.

We claim:

1. Expandable anode for diaphragm electrolysis cells comprising a conductor bar made of a copper core and a titanium layer and a first pair of flexible expanders fixed at one end thereof to the conductor bar by welding points, and anode surfaces welded to the other ends of the expanders, characterized in that in order to decrease the voltage drop between the anode surfaces and the copper core of the conductor bar, said anode is provided with a second pair of flexible expanders fixed to said conductor bar by means of welding points arranged along the circumference of the conductor bar orthogonally with respect to the welding points of said first pair of expanders, said anode surfaces being also fixed to both pairs of expanders.

2. The anode of claim 1, characterized in that the welding points are obtained by electric arc or resistance welding.

3. Method for improving the operation of an existing anode of diaphragm electrolysis cells comprising a conductor bar made of a copper core and a titanium layer and a first pair of flexible expanders fixed at one end thereof to the conductor bar by welding points and anode surfaces fixed to the other end of said expanders, characterized in that it comprises fixing an additional pair of flexible expanders to said conductor bar by means of welding points arranged along the circumference of the conductor bar orthogonally with respect to the welding points of said first pair of expanders and fixing the anode surfaces to said pairs of expanders.

4. The method of claim 3, characterized in that it comprises applying said welding points by electric arc or resistance welding.

5. In a diaphragm electrolysis cell provided with a plurality of pairs of anodes and cathodes, the improvement comprising using as the anodes, an anode of claim 1.

6. In a process for the electrolysis of brine to form chlorine and caustic in a diaphragm electrolysis cell, the improvement comprising using an electrolysis cell of claim 5.

* * * * *